US006477880B1

(12) United States Patent
Zimmer

(10) Patent No.: US 6,477,880 B1
(45) Date of Patent: Nov. 12, 2002

(54) FLANGING DEVICE WITH PRESSING AND CLAMPING ELEMENTS

(75) Inventor: Ernst Zimmer, Neusäss (DE)

(73) Assignee: Kuka Schweissanlagen GmbH (DE)

( * ) Notice: Subject to any disclaimer, the term of this patent is extended or adjusted under 35 U.S.C. 154(b) by 0 days.

(21) Appl. No.: 09/600,620

(22) PCT Filed: Jan. 22, 1999

(86) PCT No.: PCT/EP99/00402

§ 371 (c)(1),
(2), (4) Date: Jul. 18, 2000

(87) PCT Pub. No.: WO99/37419

PCT Pub. Date: Jul. 29, 1999

(30) Foreign Application Priority Data

Jan. 24, 1998 (DE) ..... 298 01 153
Jan. 24, 1998 (DE) ..... 298 01 147

(51) Int. Cl.[7] ..... B21D 5/04
(52) U.S. Cl. ..... 72/323; 72/316; 29/243.58
(58) Field of Search ..... 72/322, 323, 319, 72/316, 386; 29/243.58, 243.57

(56) References Cited

U.S. PATENT DOCUMENTS

| | | | | |
|---|---|---|---|---|
| 799,409 A | * | 9/1905 | Slaysman | 413/72 |
| 826,807 A | * | 7/1906 | Slaysman | 72/323 |
| 1,764,318 A | * | 6/1930 | Kruse | 72/319 |
| 5,237,734 A | * | 8/1993 | Polon | 29/243.58 |

FOREIGN PATENT DOCUMENTS

| | | | |
|---|---|---|---|
| DE | 1155414 | * | 8/1960 |
| DE | 25 29 927 B1 | | 12/1976 |
| DE | 27 34 999 A1 | | 3/1978 |
| DE | 43 30 683 C2 | | 3/1995 |
| DE | 44 12 590 A1 | | 10/1995 |
| DE | 44 18 684 A1 | | 11/1995 |
| DE | 196 20 247 A1 | | 11/1997 |
| DE | 196 52 453 A1 | | 6/1998 |
| EP | 0 579 893 A1 | | 1/1994 |
| EP | 0 787 546 A1 | | 8/1997 |
| GB | 929 840 | | 6/1963 |
| GB | 1 080 471 | | 8/1967 |
| JP | 2-15830 | * | 1/1990 |
| JP | 3-94926 | * | 4/1991 |
| JP | 06 297046 A | | 10/1994 |
| JP | 9-38733 | * | 2/1997 |
| WO | WO 89/09101 | | 10/1989 |
| WO | WO 95/21711 | | 8/1995 |

* cited by examiner

*Primary Examiner*—Daniel C. Crane
(74) *Attorney, Agent, or Firm*—McGlew and Tuttle, P.C.

(57) ABSTRACT

A flanging or hemming device (1) is provided with an external flanging unit (6) and/or an internal flanging unit (7) as well as a clamping device (3). The clamping device (3) has one or more leading pressing and clamping elements (71) which are movable or deformable and can be adjusted in accordance with the place or time and/or force with which they act on the workpiece or work-pieces (9). The pressing and clamping elements (71) are notably elastically deformable. They can also comprise a spring (72) or be fluidically pre-stressed.

8 Claims, 16 Drawing Sheets

2
12
14
15
16
17
18
19
20
24
25
27
29
30
31
32
34
37
6,11

FLANGING DEVICE WITH PRESSING AND CLAMPING ELEMENTS

FIELD OF THE INVENTION

The present invention pertains to a hemming apparatus with an outer hemming device and/or an inner hemming device as well as a clamping device with pressing and clamping elements

BACKGROUND OF THE INVENTION

Such a hemming apparatus has been known from DE-A 43 30 683. It has a hemming bed that can be raised and lowered and two hemming units, each of which has two different hemming tools for prehemming and finishing hemming. The hemming drive is arranged on the hemming bed, which performs the hemming stroke by a lifting movement. The hemming units can be pivoted only onto the hemming bed, and the prehemming and finishing hemming tools are brought into the working position by a vertical adjustment of the hemming bed. The workpiece is clamped on the hemming tools, which grasp the workpiece together and simultaneously, via spring-loaded holding-down devices.

SUMMARY AND OBJECTS OF THE INVENTION

The object of the present invention is to provide a better hemming apparatus.

According to the invention, a hemming apparatus is provided with an outer hemming device and/or an inner hemming device as well as a clamping apparatus with pressing and clamping elements. The clamping apparatus has one or more leading pressing and clamping elements.

The hemming apparatus according to the present invention can operate with different clamping apparatus. The use of leading pressing and clamping elements, which make possible a predeterminable clamping sequence of any freely selectable points of the workpiece or workpieces, is particularly advantageous. These pressing and clamping elements are mounted in such a way that they are deformable or can yield, so that their leading function can be eliminated at the end of the clamping movement so that a simultaneous clamping of the workpiece or workpieces takes place at all intended points.

The hemming apparatus according to the present invention require little design effort and have freely settable and adjustable kinematics. Retooling operations and tool change can be performed rapidly and simply. The hemming unit can be controlled very easily and accurately. The drive is uncomplicated. The entire hemming unit is insensitive to disturbances and also has a high reliability in operation due to the small number of moving parts. This also leads to advantages for simple and inexpensive maintenance.

The basic components of the hemming units are standardized and independent from the shape of the workpiece. They can therefore be manufactured in advance and can be reused in the case of a tool change.

The hemming apparatus according to the present invention makes it possible, in particular, to change the hemming tools independently from the hemming stroke. It is particularly advantageous in this connection that the hemming stroke can be very short and can be carried out with a high force. In particular, the hemming head according to the present invention does not require an additional height and feed height in the hemming area. This is especially true in the case of the preferred design as a rotating roll. If a plurality of hemming units are used, their hemming tools can be changed independently from one another.

The entire hemming unit is compact and can be placed especially favorably and simply on the hemming apparatus as a result. In addition, the small overall height offers advantages concerning the other components. For example, the rotating roll makes possible tool change under the clamping apparatus, which can remain as a result in position at the workpiece and holds same during the tool change. The small overall height makes it possible, in addition, to arrange the hemming unit obliquely in order to thus optionally achieve a better direction of the hemming force at right angles to the surface of the workpiece. If the hemming unit according to the present invention is arranged obliquely on the outside of the workpiece, the present invention has the advantage that the interference distance from a possible inner hemming device is greater because of the small overall height of the hemming unit.

The design of the hemming unit according to the present invention also makes it possible to use hemming tools of any desired shape and size. A longer or multipart hemming head, which is arranged on two or more hemming units and is supported via intermediate supports in a suitable manner, may be optionally used for this purpose.

The hemming head may carry a plurality of hemming tools. In the preferred embodiment, it carries two hemming tools for prehemming and finishing hemming. The design of the hemming head as a rotating roll has the advantage that an especially simple kinematics with reliable guiding and setting is guaranteed for adjusting the tool. In particular, the hemming head can be set and positioned completely independently from the hemming drive, which generates the hemming stroke. The pivoting drive for the hemming head preferably has a crank drive. This makes it possible to make do with weaker driving forces for adjusting the hemming head and to nevertheless generate strong, positive-locking holding forces in the working position in order to thus transmit correspondingly strong hemming forces.

The hemming tools may have one or more centering inserts, which have a stop and centering function for the workpiece or workpieces. These centering stops are also advantageous for holding and positioning the workpiece during tool change and during the turning of the hemming head. Special advantages arise when the hemming apparatus is designed as a combination device with an outer and inner hemming device.

The centering inserts facilitate the staggered feed in time of the hemming unit. The final shape of the workpiece can be influenced as a result. In addition, errors due to warping or dimensional errors can be compensated.

The hemming unit may have one or more movable and driven tensioners or clamps, which can be actuated independently from the hemming tools. It is advantageous in this connection for the clamps to be arranged behind the hemming heads and to extend over them. As a result, the hemming heads can be rotated under the clamps for tool change, while the workpiece or workpieces can remain clamped during a tool change staggered in time. The clamps associated with the hemming unit or hemming units may replace an internal clamping device, e.g., a vertical or pivotable clamping frame. They may alternatively also complement same.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
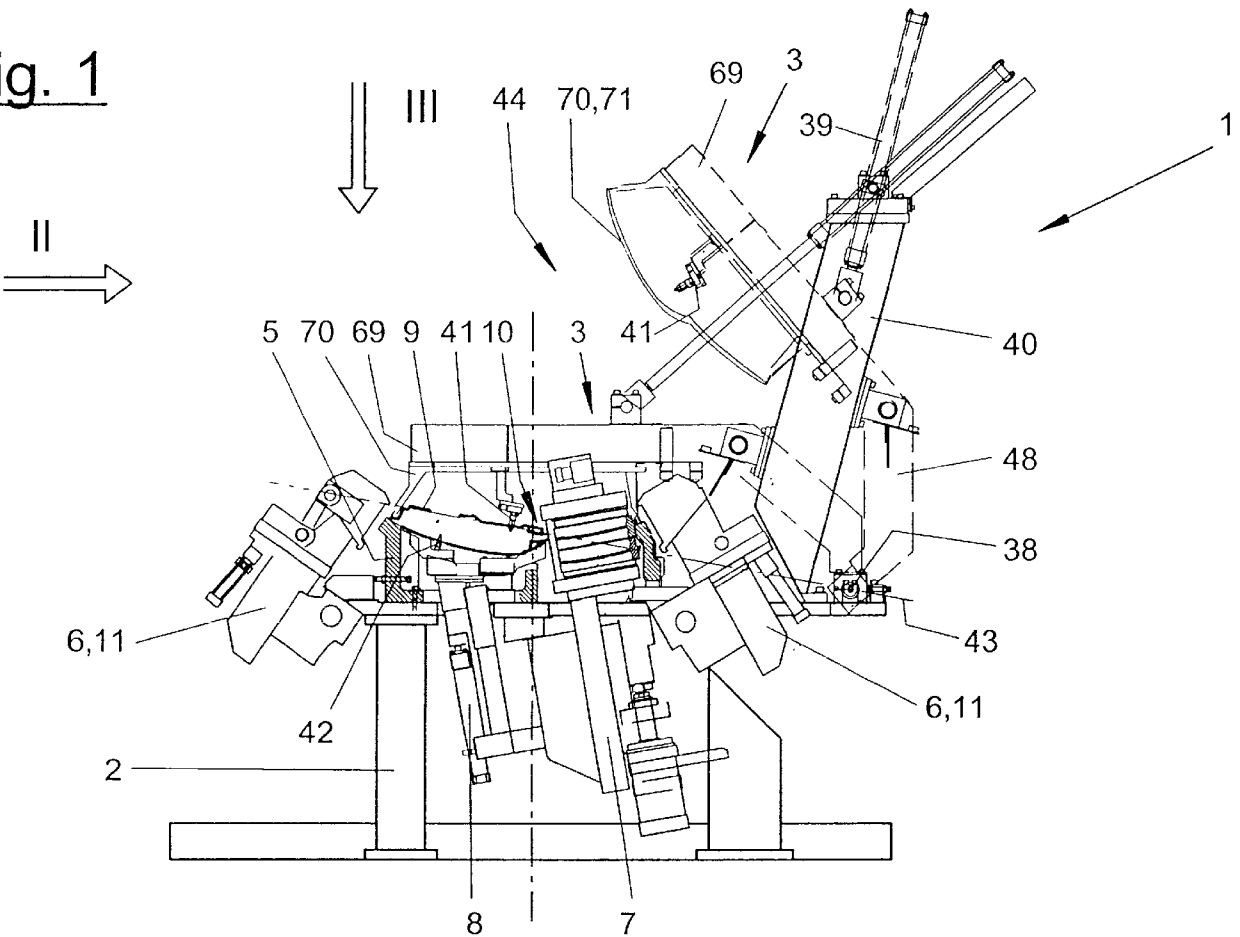
FIG. 1 is a side view of a hemming apparatus with outer and inner hemming device and a pivotable clamping frame.
Figure 2:
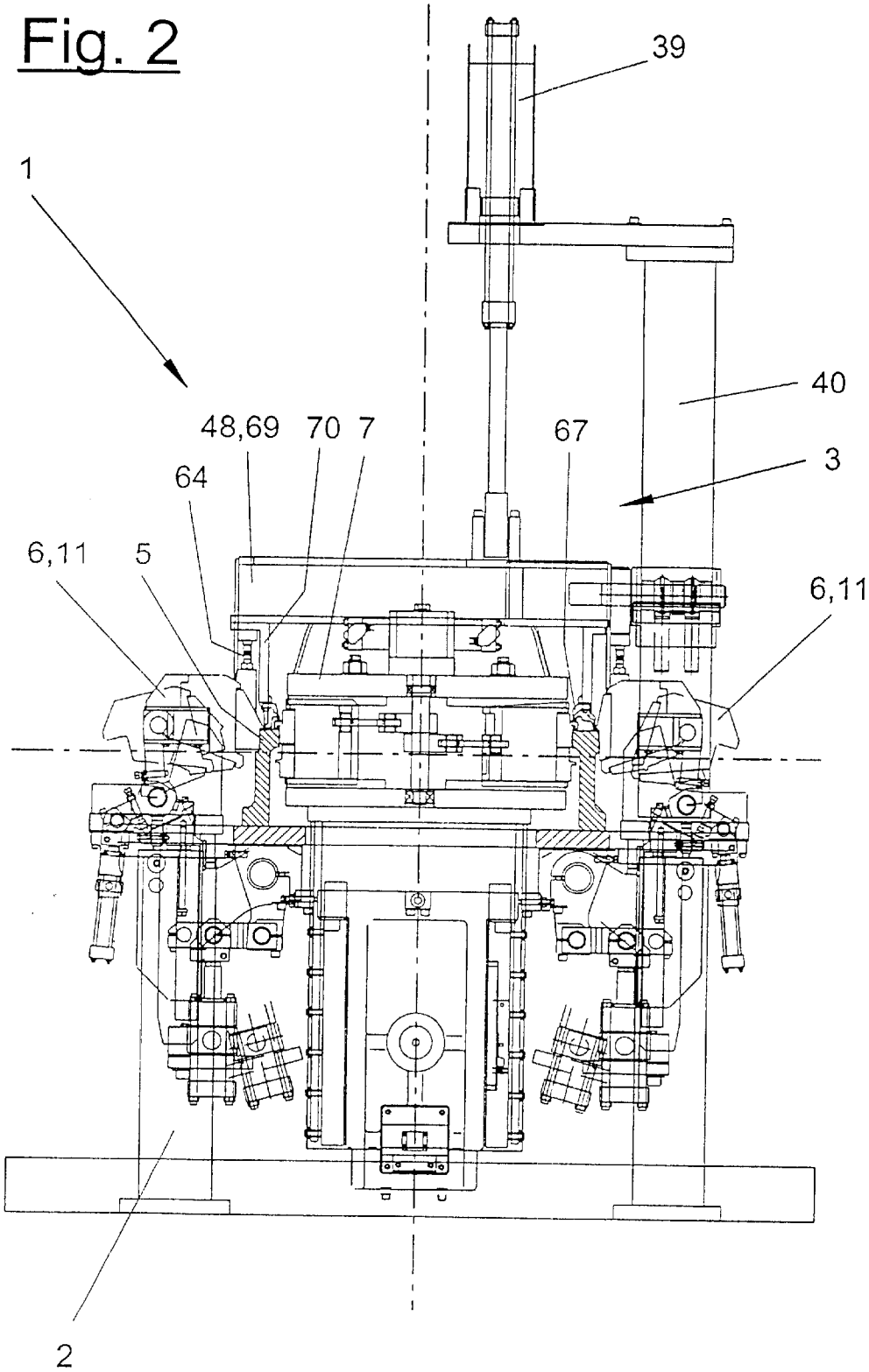
FIG. 2 is a front view of the hemming apparatus according to arrow II in FIG. 1.
Figure 3:
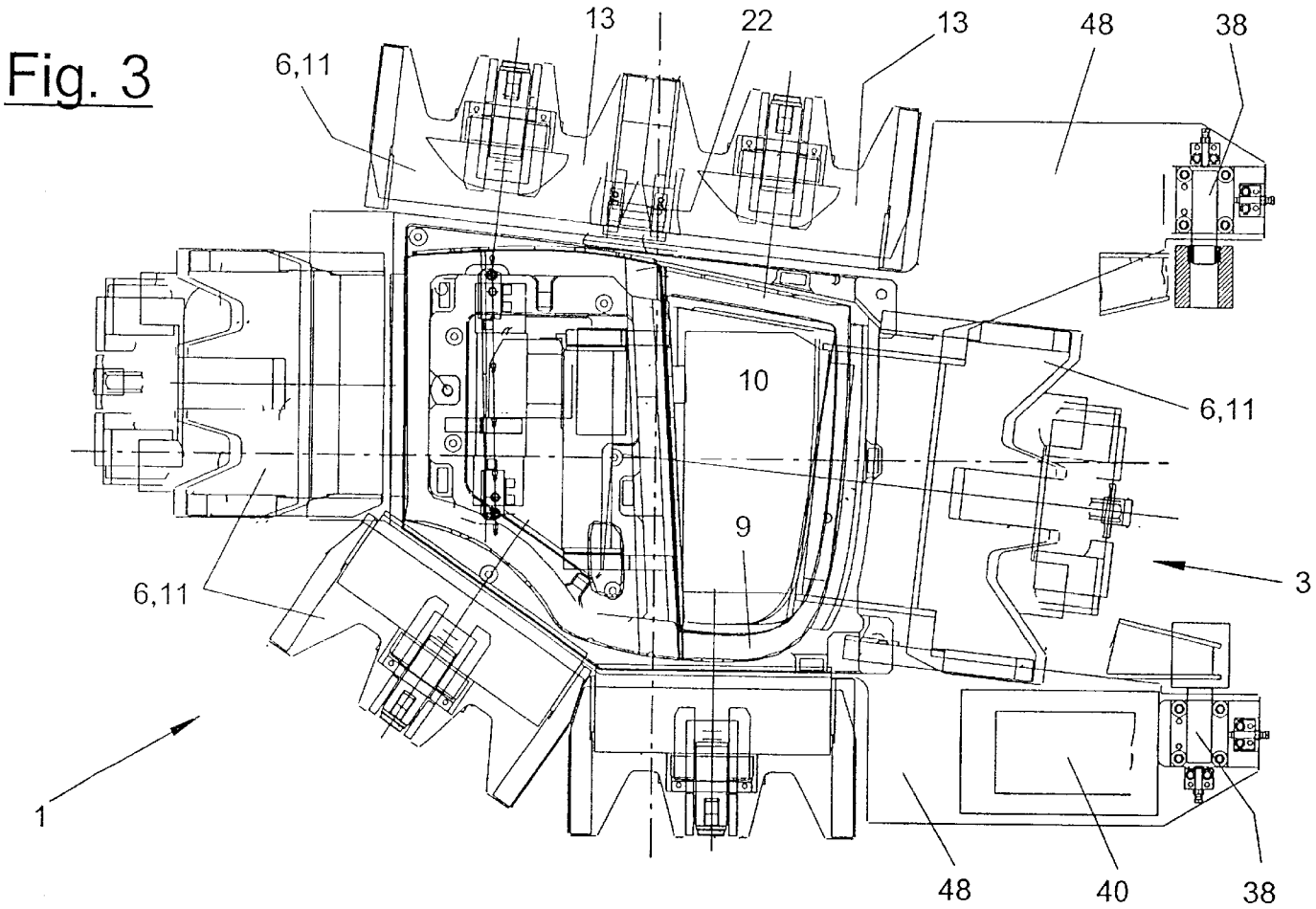
FIG. 3 is a top view of the hemming apparatus according to arrow III in FIG. 1.

FIGS. 1 through 3 show general views of a hemming apparatus 1. This comprises a machine frame 2, on which a plurality of outer hemming devices 6 and one or more inner hemming devices 7 are arranged. In addition, a pivotable clamping apparatus 3 with a clamping frame 69 is arranged on the machine frame 2. Moreover, a lifter 8 is located on the machine frame 2.

Figure 16:
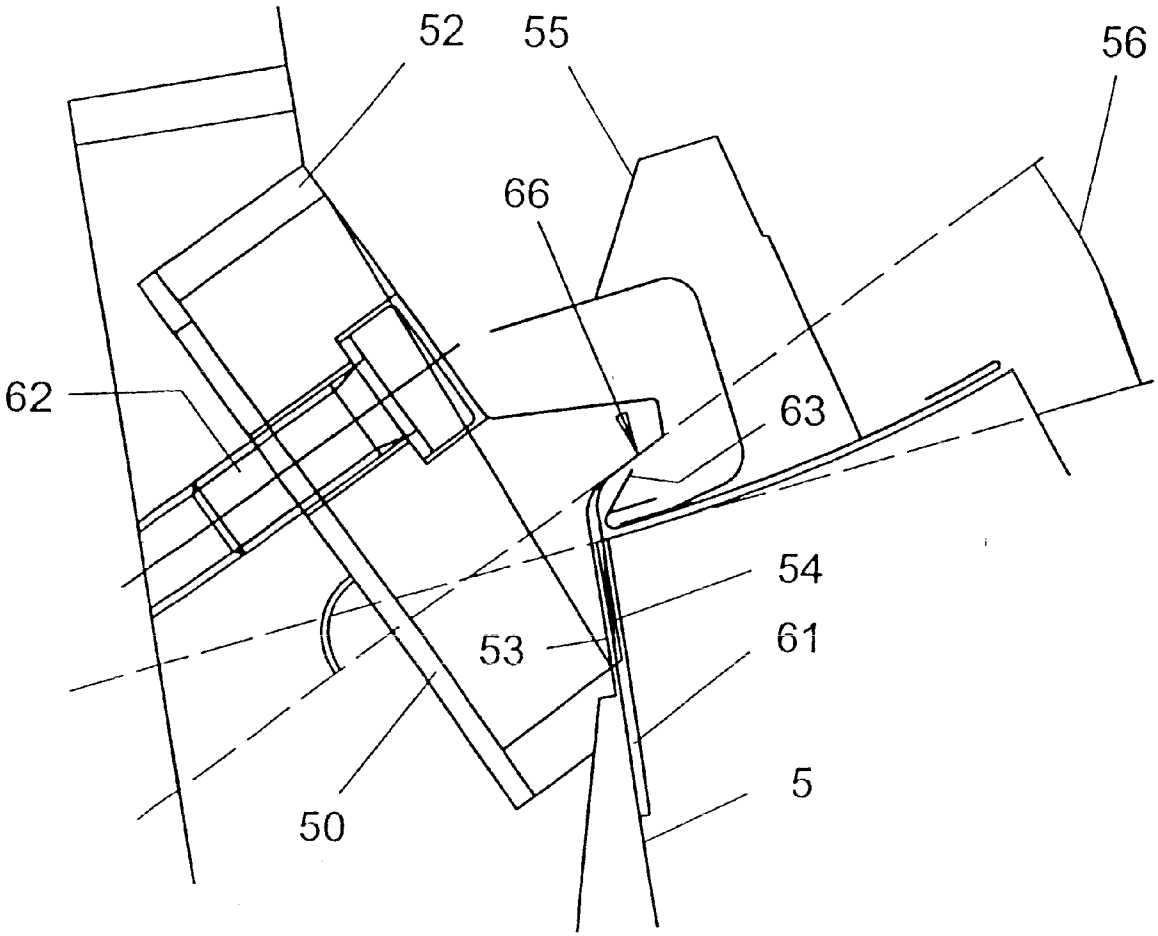
FIG. 16 is an enlarged side view of the centering insert according to FIG. 14.

The hemming apparatus 1 is intended for processing one or more workpieces 9, in which prepared hemming flanges 63 see FIG. 16 are first prehemmed and then subjected to finishing hemming. The workpieces 9 may be any parts. In the preferred embodiment, the hemming apparatus 1 is used to process vehicle body parts, especially doors. The workpieces 9 may have one or more openings 10. These openings may be, e.g., window cutouts or the like.

Prehemming and finishing hemming of the workpieces 9 can be carried out with the hemming apparatus 1 within one station. In addition, the hemming apparatus 1 makes it possible to carry out inner and outer hemming in the same station. The inner and outer hemming may happen simultaneously or staggered in time. The inner hemming takes place in the area of the openings 10, especially window cutouts.

The workpieces 9 are fed in in the correct position by apparatus of a suitable conveying apparatus. In the preferred embodiment, the feed is performed by apparatus of a multiaxial industrial robot, which also removes the workpieces 9 after the hemming.

The machine frame 2 has a hemming bed 5 with suitable supports for receiving one or more workpieces 9. The hemming bed 5 may also have one or more positioning or centering pins for positioning the workpiece or workpieces 9 in the correct position. The workpieces 9 are pressed onto the hemming bed 5 by the clamping frame 69, which will be described in greater detail below, and held in the desired position. The clamping frame 69 may have on its underside a clamping contour 70, whose shape is adapted to the workpieces 9, and optionally one or more pressing and clamping elements 71. One or more centering pins 41 or other positioning aids may also be present on the clamping apparatus 3.

The lifter 8 is arranged obliquely and essentially in parallel to the inner hemming device 7, which will be described in greater detail below. It is located in the inner area and essentially under the machine frame 2 and the hemming bed 5. It is used to receive and position the workpieces 9. Due to the pivotable clamping frame 69, a laterally and upwardly wide open access opening 44 is obtained in the open position of the clamping frame, and the feed apparatus or the above-mentioned industrial robot feeds and removes the workpieces 9 through the said access opening.

For feeding the workpieces 9, the lifter 8 is in an extended position (not shown). The lifter 8 has a plurality of suitable mounts for receiving and supporting the workpieces 9. Centering pins 42 or other positioning elements, which may be designed, e.g., as an accurate centering apparatus for the workpieces 9 fed in on the lifter 8, may be arranged on the mounts.

The feed apparatus or the industrial robot places the workpiece or workpieces 9 onto the extended lifter 8 in the correct and correctly centered position. The lifter 8 then moves back and positions the workpiece or workpieces 9 on the hemming bed 5. The lifter 8 may form with its mounts a part of the hemming bed 5 and preferably remains connected to the workpiece or workpieces during hemming. The workpieces 9 are thus held in the correct position in the hemming apparatus 1 and can be processed in the manner to be described below. After hemming, the lifter 8 again extends obliquely upward and makes the workpieces 9 available to the feed apparatus for being removed.

The inner hemming device 7 has hemming tools 16, 17, which can be extended and withdrawn, so that the workpieces 9 with the opening 10 can be placed on the hemming bed 5 past the inner hemming device 7. The outer hemming device 6 can be returned into a resting position and makes free the access to the lifter 8 and the workpieces 9 for feeding and removal.

The outer hemming device 6 and the inner hemming device 7 can be positioned and aligned independently from the workpieces 9 independently from one another and actuated separately. They have for this purpose a plurality of hemming units 11 that can be actuated separately with hemming drives 14 of their own. The inner hemming device 7 has hydraulic drives for withdrawing and extending the hemming tools 16, 17 and for the hemming stroke. It is preferably designed corresponding to DE-U 296 12 192.

The outer hemming device 6 is shown in greater detail in FIGS. 4 through 7. It comprises one or more hemming units 11, which are mounted preferably hanging on the machine frame 2 or the hemming bed 5 and together with their hemming tools 16, 17 that surround the outer contour of the workpieces 9 to be hemmed. The hemming units 11 have a hemming head 12 and a hemming drive 14 each. The hemming head 12 carries the hemming tools 16, 17. These are, e.g., hemming tools for prehemming and finishing hemming.

Figure 11:
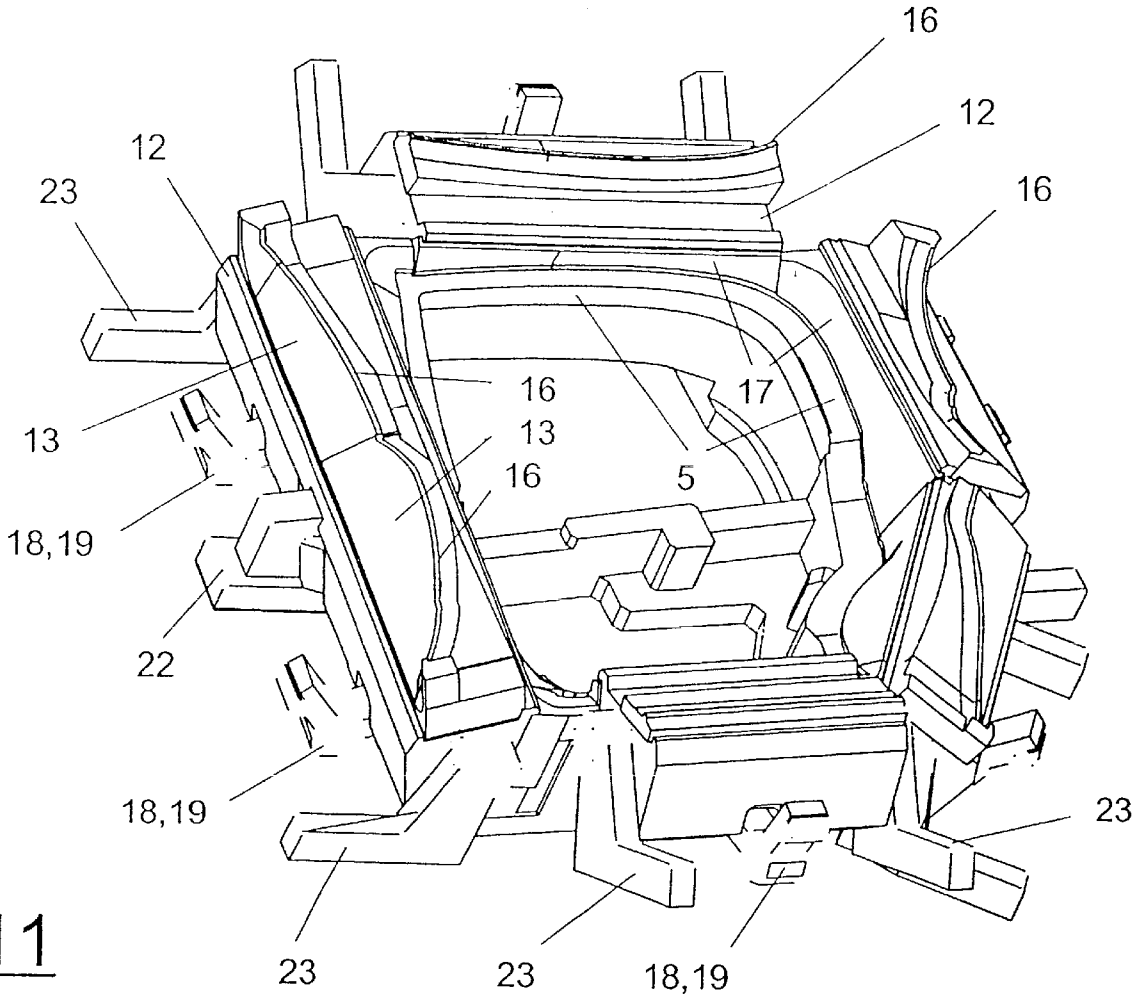
FIG. 11 is a perspective view of the hemming heads and hemming tools on the hemming bed.

The hemming tools 16, 17 usually have the same length as the hemming heads 12. In a variant, it is also possible for the lengths to be different and for divisions to be formed by, e.g., one hemming head 12 having excessive length and carrying two or more shorter prehemming and finishing hemming tools 16, 17 arranged axially one behind the other. This arrangement is shown in FIG. 11.

The hemming tools 16, 17 are fastened replaceably on prepared recessed mounts via suitable inserts. The mounts are dimensioned such that they can grasp inserts and tools of different sizes. The prehemming and finishing hemming tools 16, 17 are now located in different locations of the hemming head 12.

Figures 4, 5, 6:
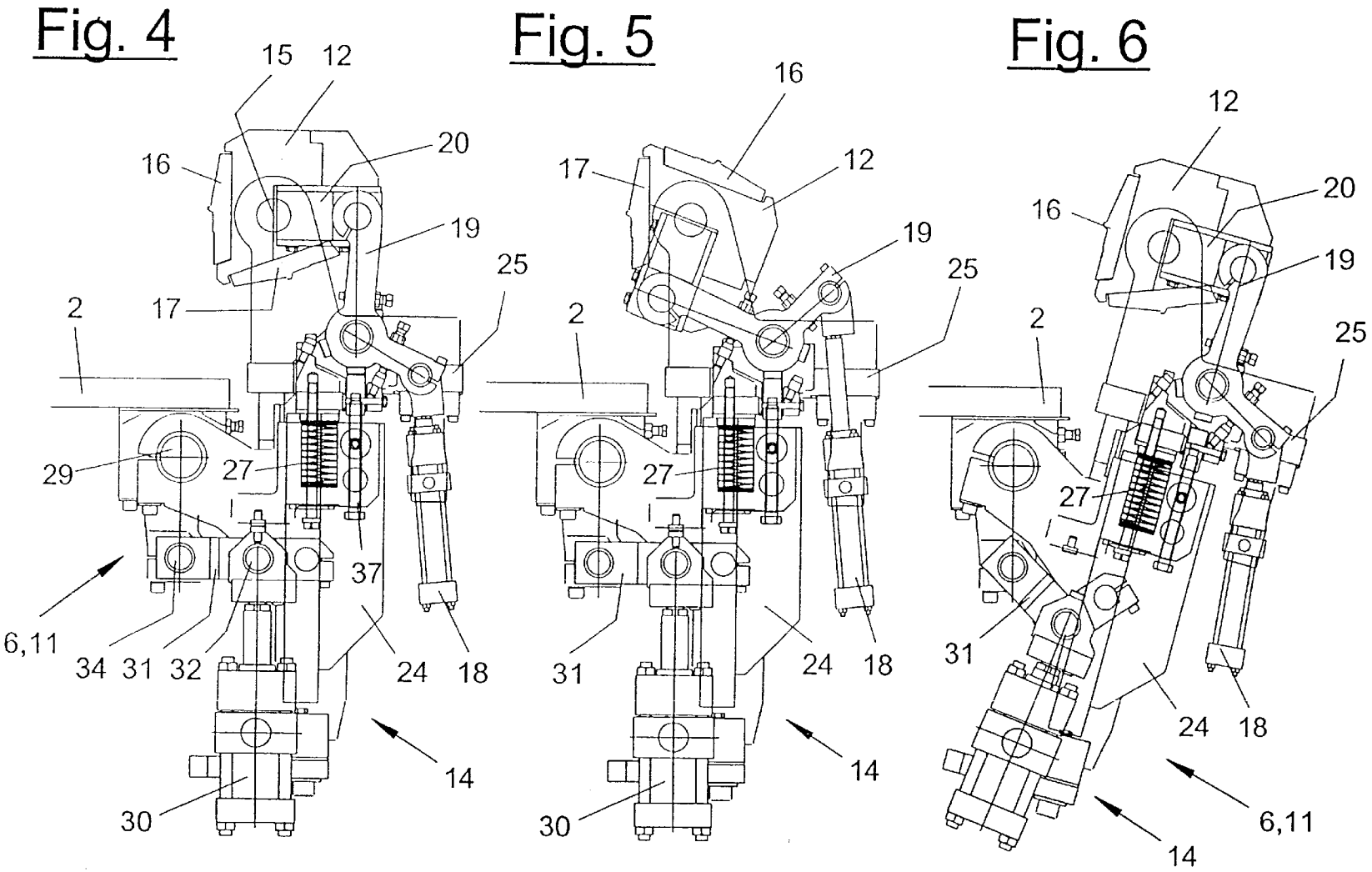
FIG. 4 is a side view of a hemming unit with a hemming head in an operating position.
FIG. 5 is a side view of a hemming unit with a hemming head in another operating position.
FIG. 6 is a side view of a hemming unit with a hemming head in another operating position.
Figure 7:
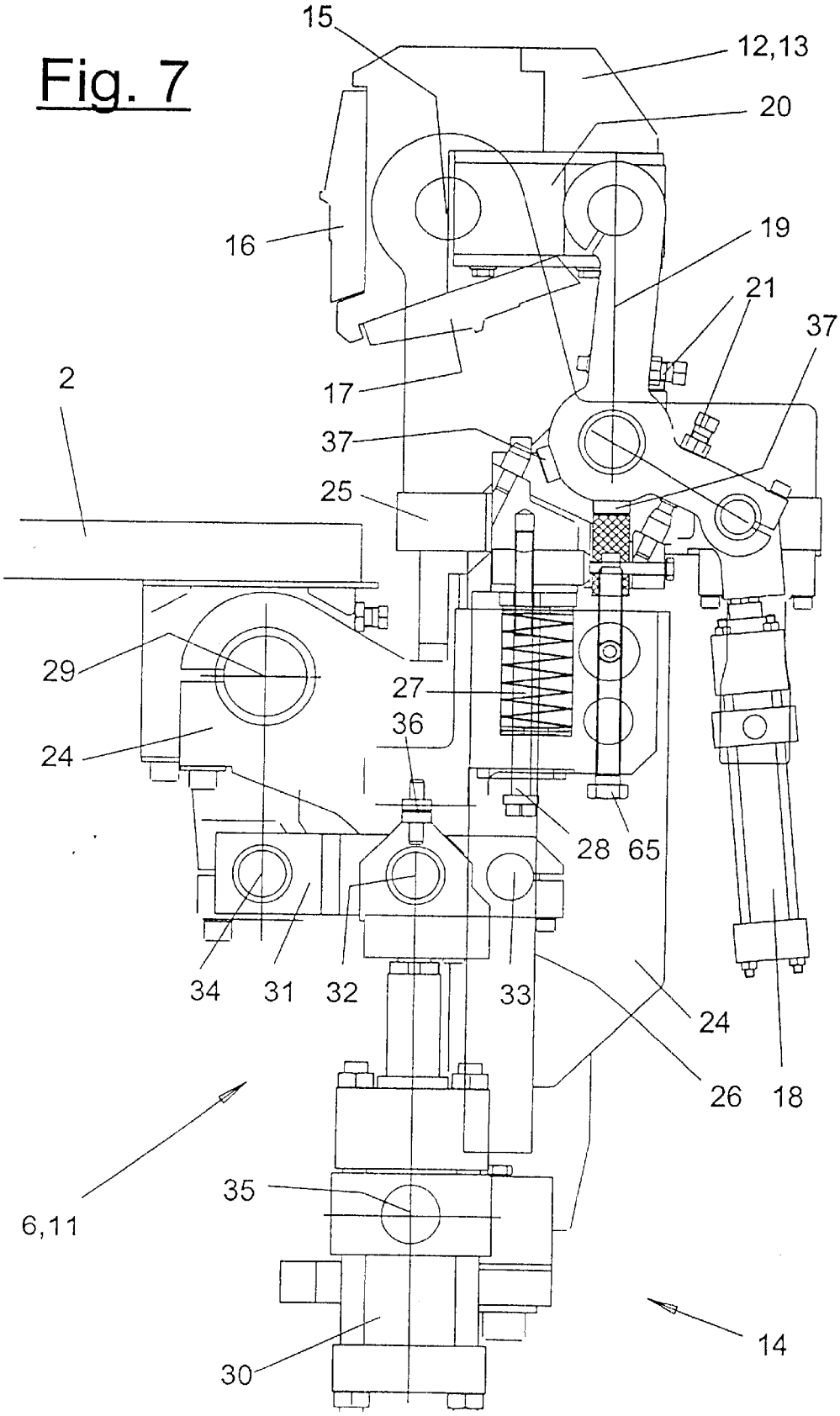
FIG. 7 is an enlarged side view of the hemming unit according to FIGS. 4 through 6.

The hemming head 12 is independently adjustable in relation to the hemming drive 14 to be described below. It brings the hemming heads 16, 17 into the particular working position by a movement of the head. FIG. 4 shows the hemming head 12 in the prehemming position. FIG. 5 shows the finishing hemming position and FIG. 6 shows the resting position, in which the entire hemming unit 11 is pivoted away from the machine frame 2.

The hemming head 12 may be movable in different ways. In the preferred embodiment, the hemming head 12 is designed as a rotating roll, which is mounted pivotably around an essentially horizontal axis on end bearings 23.

Figure 12:
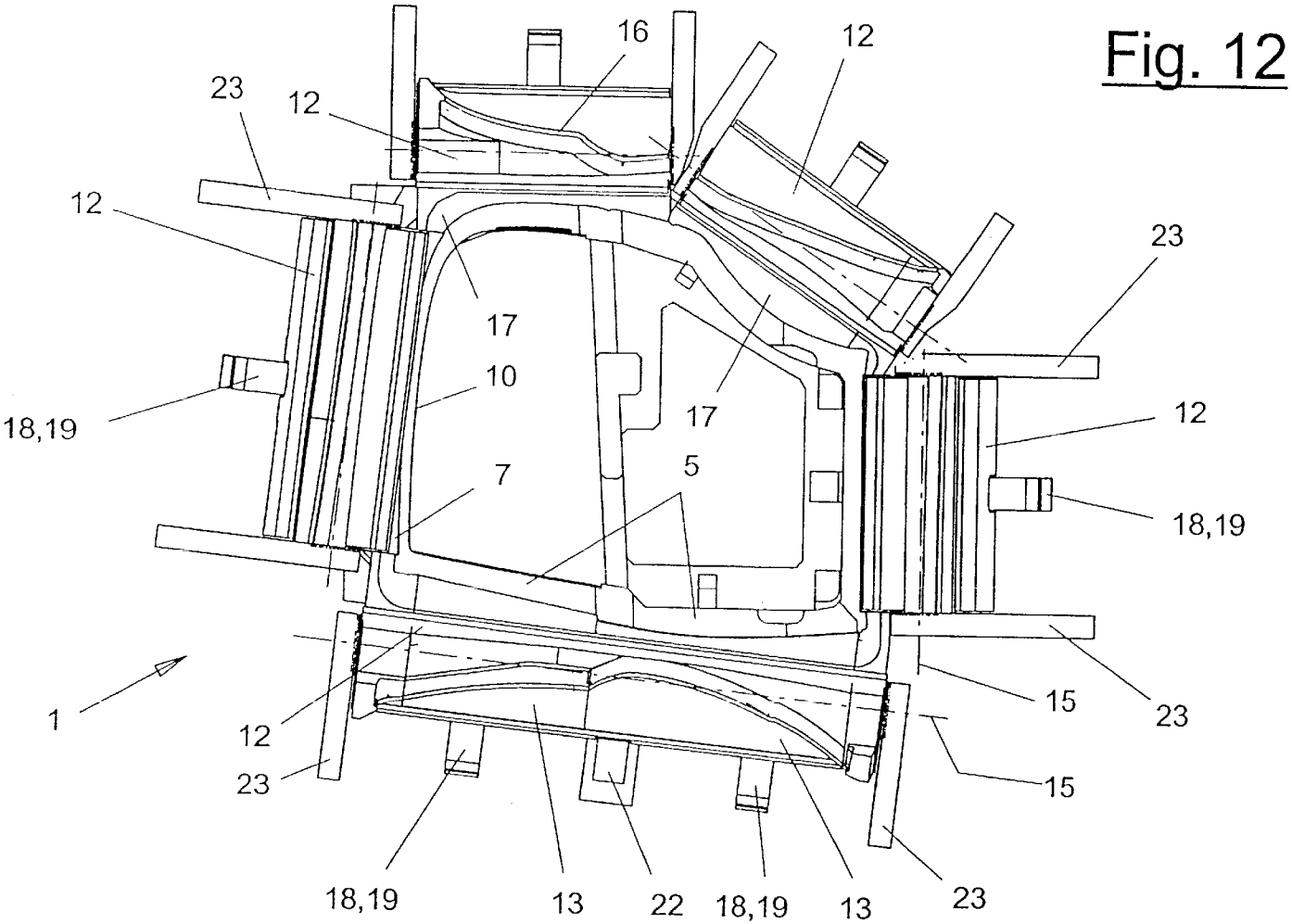
FIG. 12 is a top view of the arrangement according to FIG. 1.

The hemming head 12 or the rotating roll may also have a greater length and be divided into a plurality of hemming head sections 13, which are driven together. The hemming head sections 13 are now mounted and supported rotatably on the inner contact point or contact points via intermediate bearings 22. This arrangement is shown in FIGS. 11 and 12.

The hemming head 12 or the individual hemming head section 13 is moved by a pivoting drive 18. The prehemming and finishing hemming tools 16, 17 are brought into the working position by the rotary movement. They are arranged diagonally close to one another on the hemming head 12 and form an angle of preferably about 90° to 120° with one another. The hemming head 12 now performs an alternating rotary movement through a corresponding angle of rotation.

The pivoting drive 18 comprises a suitable drive member, e.g., a pneumatic cylinder, and a suitable movement transmission apparatus, e.g., a crank drive 19. The crank drive 19 is connected via one arm to the piston rod of the cylinder, which is arranged essentially vertically. The other crank arm is connected to the hemming head 12 via a crank 20. The crank arm now acts on a sliding block, which is held movably to and fro in a suitable crank guide on the hemming head 12.

The angular position of the crank arms is between about 90° and 140° and is preferably selected to be such that the crank arm leading to the hemming head 12 is essentially at right angles to the crank guide 20 in the prehemming position shown in FIG. 4 and it applies the necessary holding forces for the hemming stroke with the cylinder withdrawn. In the finishing hemming position shown in FIG. 5 with the cylinder extended, the crank arm leading to the hemming head 12 with its mount for the crank 20 is between the finishing hemming tool 17 and the pivot axis 15. The crank arm assumes a relatively flat and slightly obliquely upwardly directed position. It is now again essentially at right angles to the crank guide 20.

The end positions of the crank drive 19, which are also the working positions of the hemming tools 16, 17 at the same time, are limited and defined by apparatus of pivot stops 21. The cylinder 18 is only withdrawn and extended. Adjustable stop screws, which cooperate with relatively stationary stop heads, are located on the crank arms. In addition, hemming stroke stops 37 may be present on the crank head from which the two crank arms originate. These are arranged offset in different planes extending at right angles to the bearing axis of the crank drive 19 and around the pivot angle of the crank drive 19 on the circumference. In the two working positions shown in FIGS. 4 and 5, one of the two hemming stroke stops 37 points vertically downward and cooperates with respective, relatively stationary, adjustable stops. The prehemming and finishing hemming strokes can be set independently from one another and limited in the downward direction by apparatus of stop screws 65 or the like.

The hemming head 12 is fastened and mounted on a bracket 25 together with the pivoting drive 18. The bracket 25 is in turn mounted longitudinally movably on a swivel arm 24 via a bracket guide 26. The hemming stroke is carried out by the movement of the bracket 25 along the swivel arm 24. The bracket 25 forms the hemming drive 14 together with the swivel arm 24 and a hemming cylinder 30. The hemming drive 14 is separate from the pivoting drive 18 of the hemming head 12.

Figure 8:
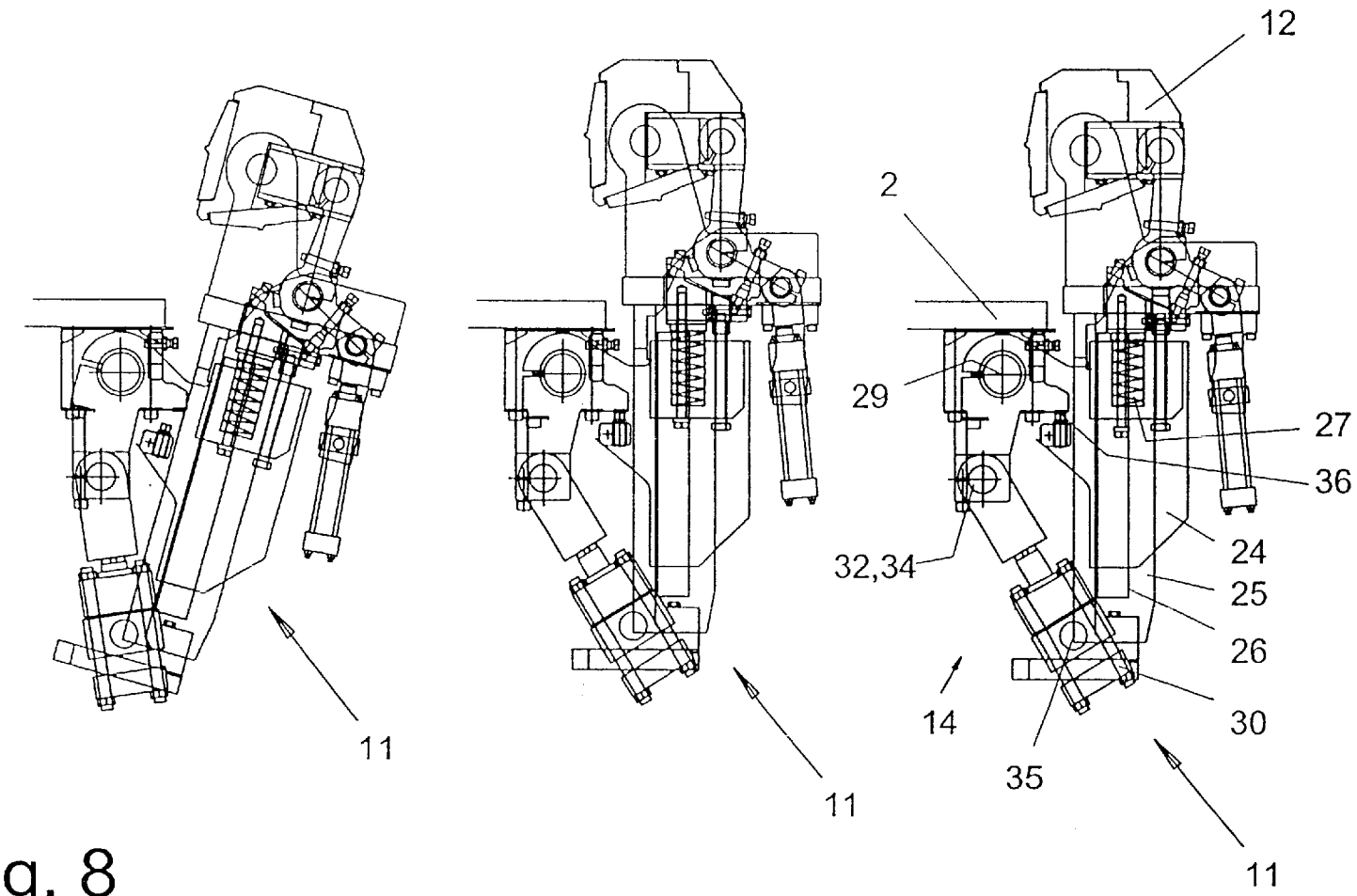
FIG. 8 is a variant of the hemming drive for a hemming unit according to FIGS. 4 through 7 in three operating positions.

FIGS. 4 through 7 show one embodiment of the hemming drive 14. FIG. 8 shows a variant to this. The hemming drive 14 generates both the feed motion and the hemming movement, doing so independently from one another and in a time sequence that can be set separately or in a separate time sequence. The hemming tools 16, 17 are brought with the feed for this purpose into a defined and statically determined operation, from which the hemming stroke is performed. To do so, all hemming units 11 are brought consecutively or simultaneously into the starting or working position, in which they can wait for one another, by apparatus of a corresponding displacement or time monitoring or control. From this position, they can perform the hemming stroke in any desired time sequence, especially together and simultaneously.

In both cases shown in FIGS. 4 through 7 and in FIG. 8, the swivel arm 24 is mounted rotatably on the machine frame 2 or a frame attachment via a bearing 29. The connection point between the bearing 29 and the machine frame 2 can be adjusted multiaxially and fixed. It is preferably used for the fine adjustment of the hemming unit 11 in relation to the hemming bed 5 and the workpiece 9. In the working positions shown in FIGS. 4 and 5, the swivel arm 24 is engaged. In the resting position shown in FIG. 6, it is pivoted off to the rear. The arrangement may be such that the hemming stroke is carried out according to FIGS. 4 and 5 with an essentially vertical movement component.

FIG. 1 shows a variant to this, in which the hemming units 11 are in an oblique position in the working position and the hemming stroke is performed in a correspondingly oblique direction of movement. The hemming stroke is preferably directed obliquely to the outside. Such an arrangement has advantages because the hemming tools 16, 17 come into contact with the opposing surface of the hemming bed 5 in a direction that is as close to the vertical as possible, because of the space requirement and because of the absence of interference in relation to the inner hemming device 7.

A spring 27, whose travel can preferably be limited by apparatus of a setting device 28, is located between the bracket 25 and the swivel arm 24. In addition, the spring 27 is pretensioned. The spring 27 is preferably designed as a compression spring and acts against the hemming cylinder 30. The spring 27 is directed in parallel to the carriage-like bracket guide 26. The setting device 28 comprises, e.g., an adjusting screw with clamping.

The upper position and the starting hemming position of the hemming tools 16, 17 and of the hemming head 12 are set by apparatus of the setting device 28. The above-described hemming stroke stops 37 define the lower hemming end position and limit the hemming stroke. The adjusting screws 65 for the hemming stroke stop are arranged on the swivel arm 24. The angular position of the hemming tools 16, 17 on the hemming head 12 is coordinated with the rotary movement of the pivoting drive 18 and the shape of the crank drive 19 such that the hemming tools 16, 17 are located essentially at the same height and position in the working position.

The hemming stroke is performed by the hemming cylinder 30, which pulls the bracket 25 downward against the force of the spring 27 on the swivel arm 24. In the embodiment according to FIGS. 4 through 7, the hemming cylinder 30 acts via a toggle lever 31. In the embodiment according to FIG. 8, the hemming cylinder 30 acts directly.

The hemming stroke is preferably in the same direction during prehemming and finishing hemming. This also applies to the outer hemming device 6 and the inner hemming device 7. The direction of the stroke is vertical or oblique. It is usually in the direction of the hemming bed 5 and downward in the exemplary embodiment being shown.

In the variant according to FIGS. 4 through 7, the hemming cylinder 30 with its housing is mounted rotatably on the bracket 25 via a cylinder bearing 35. The piston rod acts on the central bearing of the toggle lever 31 via a connection 32. One end of the lever is mounted stationarily on the machine frame 2 via a stationary lug 34. The other lug 33 of the swivel arm is arranged on the swivel arm 24.

FIG. 6 shows the pivoted-down resting position of the hemming unit 11. The hemming cylinder 30 is withdrawn and the toggle lever 31 is correspondingly buckled in this position. To pivot the hemming unit 11 into the working position shown in FIGS. 4 and 5, the hemming cylinder 30 extends and the toggle lever 31 is brought into the stretched position shown in FIGS. 4 and 5. The extending movement and the stretched position are limited and defined by a pivot stop and lever stop 36. The piston rod with the connection 32 strikes this stop 36. The hemming unit 11 is first pivoted to come into contact by this stretching movement. The cylinder force needed in this process is weaker than the opposing force of the spring 27. As a result, the force of the cylinder is deflected into the pivoting movement. There is no relative movement as yet between the swivel arm 24 and the bracket 25 and consequently there is no hemming stroke.

The force of the spring 27 is approx. 10% of the maximum force of the cylinder. For example, the spring 27 has a tensioning force of 1 ton and the hemming cylinder 30 has a force of 10 tons. In addition, the spring force is stronger than the kinetic resistances of the swivel arms 24, i.e., the inertia of masses, frictional forces, etc. As soon as the pivoted position to the machine frame 2 shown in FIGS. 4 and 5 has been reached and the hemming cylinder 30 extends farther, the cylinder force supported on the lever stop 36 is deflected into a downward movement of the bracket 25. The cylinder housing mounted in a rotatably movable manner via the cylinder bearing 35 carries the bracket 25. This movement forms the hemming stroke, during which the spring 27 is compressed by the stronger force of the cylinder. The hemming stroke is limited downward by the hemming stroke stop in the above-described manner.

After hemming, the hemming cylinder 30 again withdraws, supported by the spring 27 and brings the bracket 25 into the starting position in relation to the swivel arm 24 and the setting device 28 to come into contact with the swivel arm 24. The further withdrawing movement induces the buckling in of the toggle lever 31 and the pivoting off of the hemming unit 11 into the resting position shown in FIG. 6.

In the embodiment according to FIGS. 4 through 7, the swivel arm bearing 29 arranged hanging on the underside of the machine frame 2 is above the stationary lever bearing 34. It is preferably located above it in the vertically aligned position. In the stop position, the toggle lever 31 preferably extends horizontally and essentially at right angles to the line connecting the bearings 29, 34. The horizontal forces of reaction and the moments of reaction from the hemming are supported on the lever bearing 34 in the working position.

The toggle lever 31 is missing in the variant according to FIG. 8. The hemming cylinder 30 is mounted, instead, with its connection 32, preferably the piston rod connection, rotatably on the machine frame 2. The connection 32 has an effect similar to that of the bearing 34 and supports the forces of reaction and the moments of reaction from the hemming on the machine frame 2. With its opposite cylinder bearing 35, the hemming cylinder 30 is connected to the bracket 25 as in the first exemplary embodiment. In this variant, the bearing 29 of the swivel arm 24 is, when viewed in the horizontal plane, between the cylinder connection 32 and the cylinder bearing 35 or the bracket guide 26.

FIG. 8 shows different operating positions of the hemming unit 11 in three views. In the resting position shown on the left, the hemming cylinder 30 is directed essentially vertically and the hemming unit 11 is pivoted off similarly to FIG. 6.

The view in the center of FIG. 8 shows the starting hemming position and the view on the right shows the hemming or working position of the hemming unit 11 at the end of the hemming stroke. The hemming cylinder 30 is directed obliquely in both positions. The horizontal force component stabilizes the pivoted in hemming or working position and is supported via the bracket guide 26. In addition, the pivoting movement of the swivel arm 24 is limited in relation to the machine frame 2 by apparatus of a pivot stop 36.

This arrangement is reversed in the exemplary embodiment according to FIGS. 4 through 7, and the hemming cylinder 30 is in an oblique direction in the resting position and is directed essentially vertically in the working or hemming position. The kinematics with the hemming movement of the bracket 25, swivel arm 24 and spring 27 is otherwise the same in both exemplary embodiments.

The arrangement of the bearings and the kinematics of the hemming unit 11 are selected to be such in both exemplary embodiments according to FIGS. 4 through 7 and in FIG. 8 that an engaging moment of reaction, which turns the hemming head 12 to the workpiece 9, is generated during hemming. As long as this condition is met, the design, the mounting and the kinematics of the hemming unit 11 and of its parts may be varied as desired.

FIGS. 11 and 12 illustrate the outer hemming device 6 and the arrangement of the hemming units 11 with their hemming heads 12 in a perspective view and in a top view, respectively. The figures also show the design and the arrangement of the hemming tools 16, 17. The hemming heads 12 form with one another an essentially closed hemming contour extending around the workpiece 9 in the working position. To change the hemming tools 16, 17, the hemming units 11 are pivoted back into the resting position shown in FIG. 6. The hemming heads 12 can be rotated in this position by apparatus of the pivoting drive 18.

A plurality of pivoting drives 18, which are synchronized with one another via the intermediate bearing 22 and move the hemming head sections 13 simultaneously, may be arranged under certain circumstances in the case of excessively long hemming heads 12 with two or more hemming head sections 13. The intermediate bearings 22 offer the necessary support and prevent sagging and other deformations.

The clamping frame 69, on the one hand, and, on the other hand, optionally one or more separate clamps 4 are provided for fixing the workpiece or workpieces 9 on the hemming bed 5. These clamps 4 and their arrangement are illustrated schematically and as examples in FIGS. 9 and 10. In the exemplary embodiment according to FIG. 9, one or more such clamps or tensioners 4 are associated with the hemming units 11 of the outer hemming device 6. They extend over the hemming heads 12 and are supported on the swivel arm 24 in a suitable manner. They are preferably designed as pivoting clamps and have a tensioner bearing or clamp bearing 46 and a suitable tensioner drive or clamp drive 45, e.g., a cylinder, which is supported on the swivel arm 24 and acts on the tensioner or clamp 4 via an extension arm with the articulated bearing 49.

Figure 10:
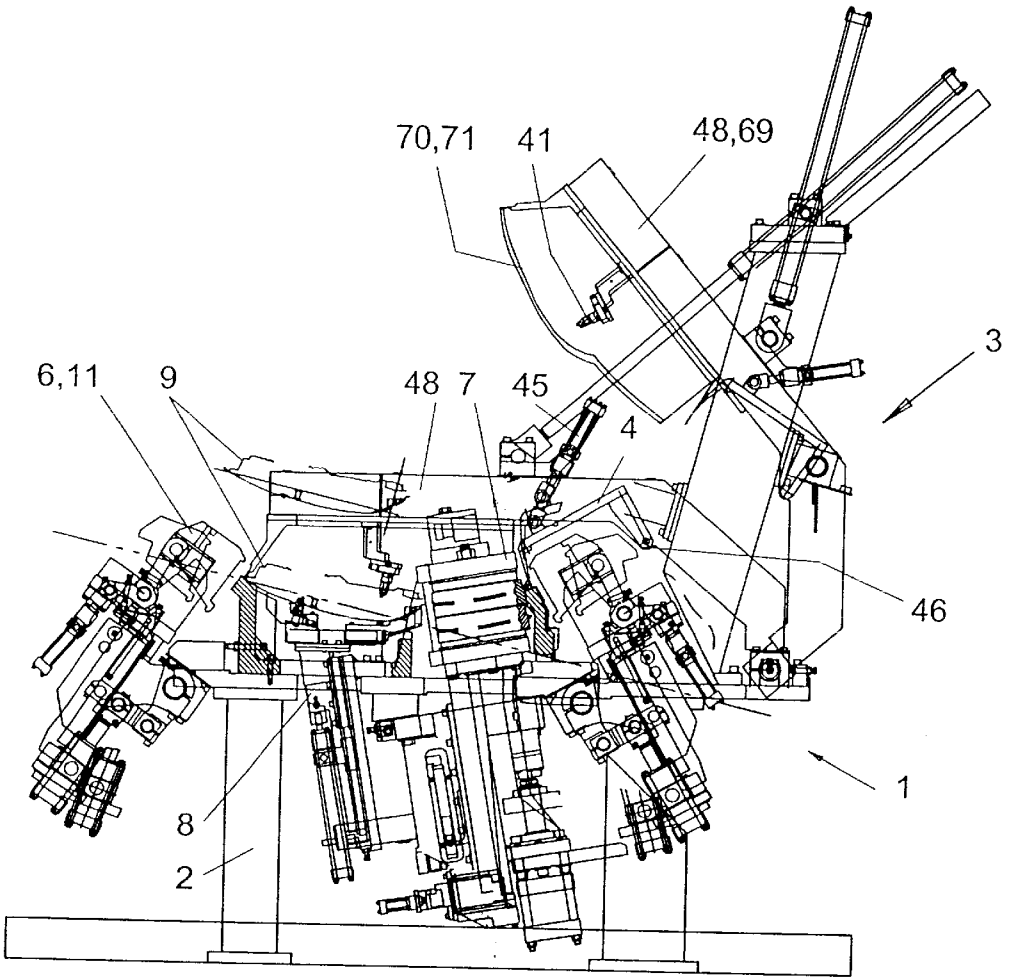
FIG. 10 is a variant to FIG. 1 with individual clamps on the clamping frame.

In the variant according to FIG. 10, one or more similar clamps 4 may be arranged on the clamping frame 69 and/or on its pivoting frame 48. The tensioner bearing 46 and the tensioner drive 45 are likewise located on the clamping frame 69 and/or on the pivoting frame 48.

The clamps 4 are designed such in both exemplary embodiments that they extend over the hemming heads 12 at spaced locations and press them onto the workpieces 9 in the immediate vicinity of the hemming points.

In the variant according to FIG. 10, the clamps 4 are shaped such on the clamping frame 69 and/or on the pivoting frame 48 that they leave sufficient free space for the hemming units 11 for being pivoted back into the resting position and for rotating the hemming head 12. As a result, the workpieces 9 remain fixed in their position and in the pressing position during tool change.

Figure 9:
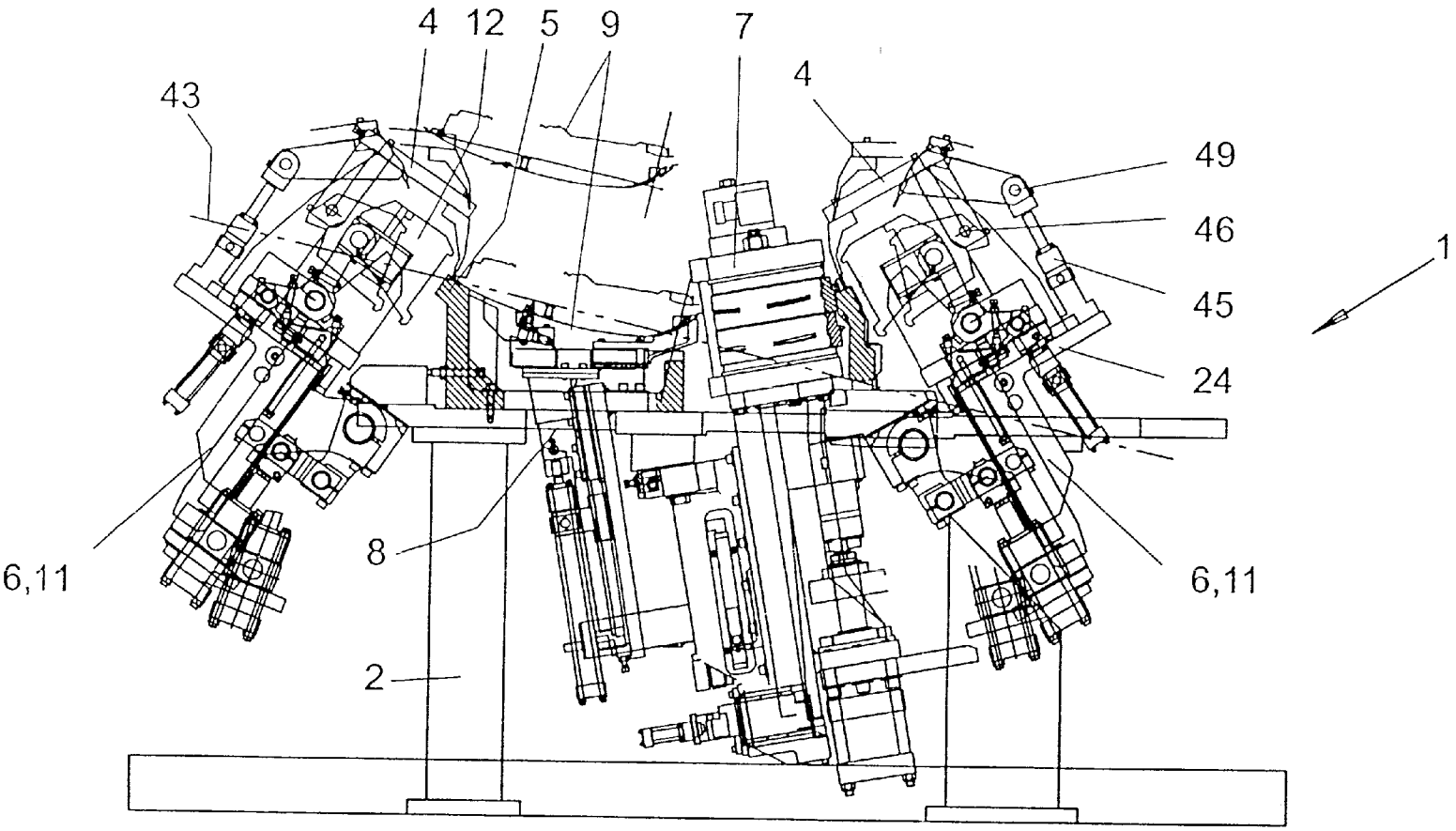
FIG. 9 is a side view of a hemming apparatus with individual clamps on the hemming units.

In the variant according to FIG. 9, the clamps 4 are opened for tool change before the hemming units 11 are pivoted back and closed again after pivoting into the working position. If the workpiece 9 is still to remain clamped, the tool change of the individual hemming units 11 can be carried out one after another staggered in time. To feed and remove the workpieces 9, the clamps 4 can always be moved sufficiently to the rear.

In the case of the arrangement of the clamps 4 with tensioner drive 45 and/or tensioner bearing 46 on the clamping frame 69 and/or on the pivoting frame 48 in the inner area of the outer hemming device 6, the specifications for FIGS. 9 and 10 must be taken into account only conditionally, because the clamps 4 do not now usually extend over the outer hemming device 6, nor do they interfere during the feed and removal of the workpieces 9.

FIGS. 1 through 3, 9, 10, and 19 through 21 illustrate the clamping apparatus 3, which may have, in particular, at least one movable clamping frame 69 and/or one or more individual clamps 4. The clamping frame 69 is mounted pivotably on the machine frame 2 by apparatus of pivoting frame bearings 38 via a frame-like pivoting apparatus 48. The pivoting frame drive 39 is preferably designed as a pivotable cylinder, which is mounted rotatably with its housing on a support column 40 of the machine frame 2. The piston rod also acts rotatingly on the pivoting frame 48. In an alternative embodiment, the clamping frame 69 may be fed in any other desired and suitable matter, e.g., by a vertical translatory movement with a corresponding drive.

On the underside, the clamping frame 69 carries the clamping contour 70 and one or more suitable pressing and clamping elements 71 for specifically pressing the workpieces 9 against the hemming bed 5. Such pressing and damping elements 71 may also be arranged on the clamps 4. Various centering pins 41 and similar other positioning elements may also be present here on the clamping frame 69 and/or on the pivoting frame 48 in the manner described in the introduction. The pressing and clamping elements may be adapted to the shape of the workpieces 9 and be rigid or movable or deformable.

In addition, some of the pressing and clamping elements 71 may be leading elements in relation to other pressing and clamping elements 71. The leading pressing and clamping elements 71 are longer than other pressing and clamping elements 71 or are positioned in areas where pressing and clamping elements 71 come into clamping contact with the workpiece or workpieces 9. As a result, the leading pressing and clamping elements 71 intentionally first press the workpiece or workpieces 9 at certain selectable points. A defined order of clamping is obtained as a result, which counteracts the undesired deformations and/or displacements of the workpiece or workpieces 9.

The leading pressing and clamping elements 71 are movable in themselves, e.g., they are spring-loaded or elastically deformable, and yield in the course of the feed in order to make possible the uniform contact of all pressing and clamping elements 71 at the end of the clamping process. In addition, the pressing and clamping elements 71 can act intentionally with different pressures on the workpiece or workpieces 9.

Figure 19:
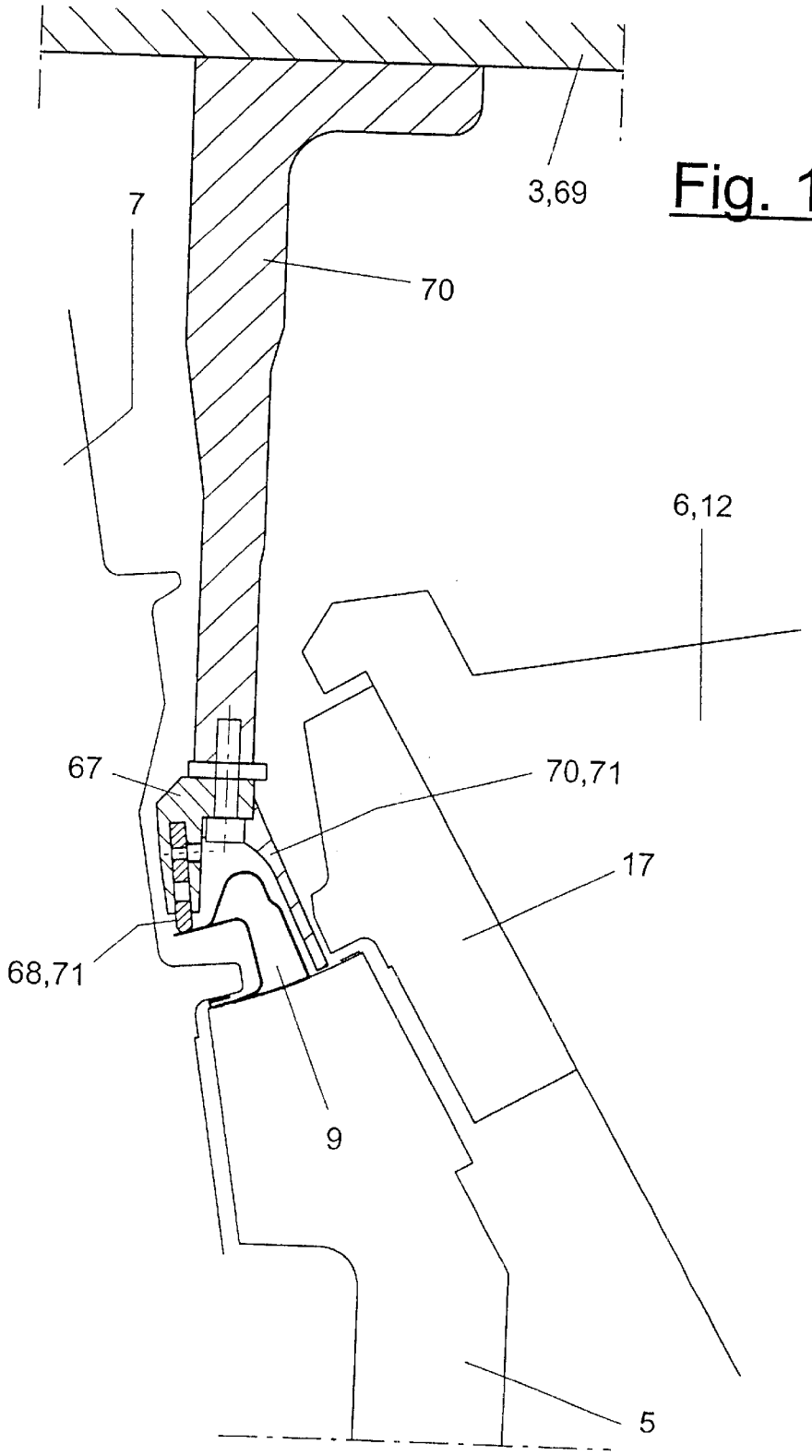
FIG. 19 is an enlarged side view of a clamping contour with a holding-down device and a pressing and clamping element.
Figure 21:
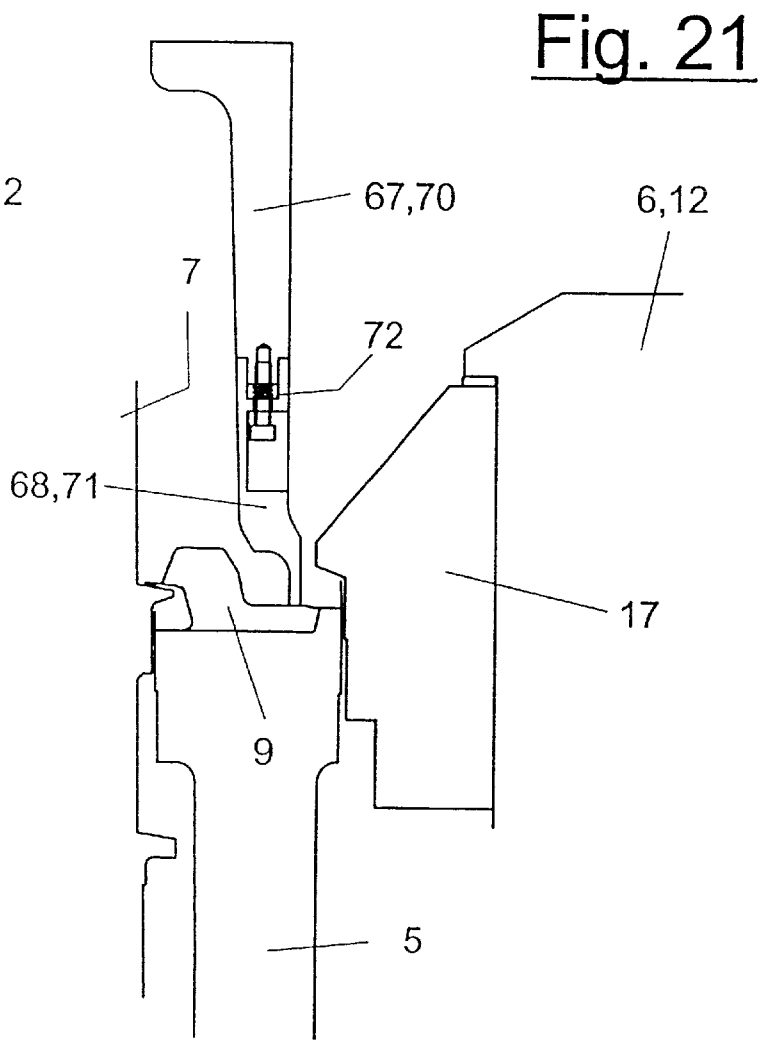
FIG. 21 is a view showing a design variant of a leading pressing and clamping element according to FIG. 19.
Figure 20:
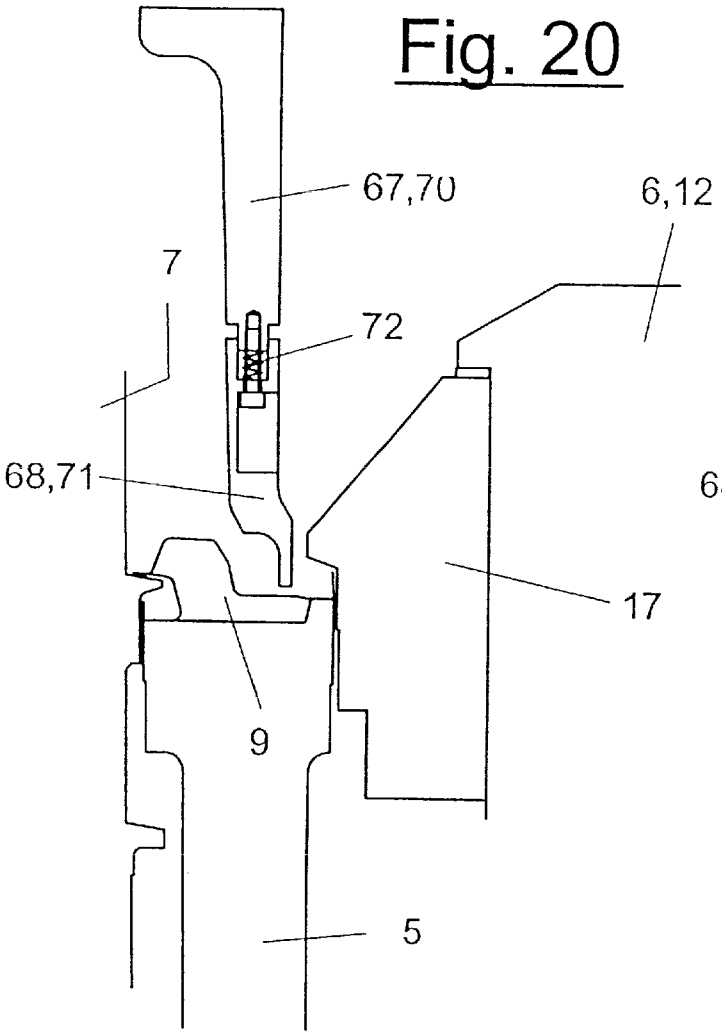
FIG. 20 is a view showing a design variant of a leading pressing and clamping element according to FIG. 19.

FIGS. 19 through 21 show an enlarged side view of such pressing and damping elements 71 on the underside of the clamping frame 69 in the clamped position on the workpiece 9. They fittingly imitate the contour of the workpiece and have one or more contact or pressure surfaces for holding and clamping the workpiece or workpieces 9 in a defined manner.

The pressing and clamping elements 71 may be, e.g., the lower part of the clamping contour 70 here. They are a component of the clamping contour 70 that is either made in one piece with it or is attached to it. However, the pressing and clamping elements 71 may also be arranged on holding-down devices 67, which are located on the clamping frame 69 or on the clamping contour 70. The holding down devices 67 may be designed as replaceable inserts and changed for adaptation to other workpieces 9. They are detachably fastened for this purpose on the underside in a recess of the clamping contour 70, e.g., by apparatus of a screw or the like.

In a variant of the embodiment shown, the holding-down devices 67 may also be located at the ends of the clamps 4 and/or on other clamping elements of the clamping apparatus 3. The holding-down devices 67 may be one-part or multipart holding-down devices.

The pressing and clamping elements 71 may be designed as movable and optionally leading pressure pieces 68, which are permanently or detachably fastened to the holding-down devices 67 or in other points of the clamping apparatus 3. The pressure pieces 68 may consist, e.g., according to FIG. 19, of a plastic or another elastic material. Corresponding to FIGS. 20 and 21, they may also be spring-mounted 72. The elasticity or the spring action can also be affected by the shaping, in addition to the selection of the material. For this purpose, the pressure pieces 68 have, e.g., one or more areas of weakened material due to recesses or perforations, which specifically allow deformations to take place in one or more directions.

As is illustrated in FIGS. 20 and 21, the elastic or spring-loaded pressure pieces 68 yield against the force of the spring 72 or due to the intrinsic elasticity of their material over the feed path of the clamping apparatus 3 after coming into contact with the workpieces 9. At the end, all pressing and clamping elements 71 are uniformly in contact with the workpieces 9, coming into the stop position on their carriers and their mobility is eliminated. The clamping force is now applied by apparatus of the feed drive of the clamping apparatus 3.

The elasticity or spring force of the pressure pieces 68 may differ. As a result, the pressure pieces 68 can act on the workpiece or workpieces 9 with difference forces or pressures. The pressure pieces 68 are particularly suitable for use as leading pressing and clamping elements 71. Their action on the workpiece or workpieces 9 in terms of location and time and/or force or pressure can be specifically set due to the possibilities of variation. The elasticity or mobility of the pressing and clamping elements may also be present without leading function.

As an alternative, the pressure pieces 68 may also consist of a hard and solid material, e.g., steel or another metal. The pressure pieces 68 are themselves adapted to the shape of the workpiece 9 in a suitable manner. FIG. 19 shows on the holding-down device 67 two pressing and clamping elements 71, of which the rear one is rigid and the front one is designed as a movable and preferably leading pressure piece 68.

In another embodiment variant, not shown, the pressing and clamping elements 71 may have a fluidic, e.g., pneumatic or hydraulic pretension. In particular, they may be designed as inflatable tube elements or the like. Furthermore, they may consist of multiple parts and be designed as movable elements in themselves e.g., telescopically or be mounted movably.

The pivoting frame 48 has multiaxially adjustable pivoting frame bearings 38. For example, the pivoting frame bearings 38 may be designed as spherical or crowned bearings with three translatory axes of adjustment.

Due to the adjustable pivoting frame bearings 38, the pivoting frame 48 and consequently the clamping frame 69 are aligned in relation to the hemming bed 5 and the workpieces 9. The adaptation is performed by the adjustment of the clamping frame 69 with the pivoting frame 48 as a whole. The mounts and the centering pins 41 or the other positioning aids are positioned individually on the pivoting frame 48 and/or on the clamping frame 69 depending on the application and are arranged adjustably and their position is preferably not changed. The clamping frame 69 itself may also comprise a plurality of parts depending on the application.

The pivoting frame bearings 38 are located close to the table surface of the machine frame 2. The pivoting frame 48 is correspondingly buckled for this purpose. In a preferred embodiment, the pivoting frame bearings 38 are located in or close to a workpiece plane 43, which is formed and defined by the centering openings on the workpieces 9. In such an alignment, the centering pins 41 dip essentially vertically into the centering openings on the workpieces 9 and exert essentially a centering action in the workpiece plane 43. Arranging the pivoting frame bearings 38 close to the table also makes it possible to have a large access opening 44.

The pivoting frame 48 and/or the clamping frame 69 may preferably have two to four or more vertically adjustable supports 64, which may be preferably arranged on the periphery or in the hemming bed area 5. These supports 64 make possible the supporting of the clamping force of the clamping apparatus 3 on the machine frame 2 and consequently a specifically partially variable clamping action on the workpiece 9 in order to permit or prevent clamping- and shape-equalizing movements of the workpiece 9 before or during the hemming operation, depending on the application.

In another embodiment, not shown, the pivoting frame bearings 38 may be arranged at a spaced location above the machine frame table 2 by apparatus of corresponding brackets or supports. Such an arrangement may be necessary, depending on the design and the arrangement of the workpieces 9, to allow the pivoting frame 48 or the clamping frame 69 to dip in the arc between the outer and optionally inner hemming devices 6, 7.

The arc-shaped clamping movement may also be replaced completely or partially or combined with straight guiding. Different shapes and positions of the workpieces 9 as well as arrangements of the hemming units 11 can thus be taken into account.

FIGS. 13 through 18 show different views of a centering apparatus for the workpiece or workpieces 9 in the hemming apparatus 1. One or more centering inserts 50, 51, 58, 59, 60 are arranged for this purpose, preferably on the hemming tools 16, 17. The drawings show different variants of this.

Figure 13:
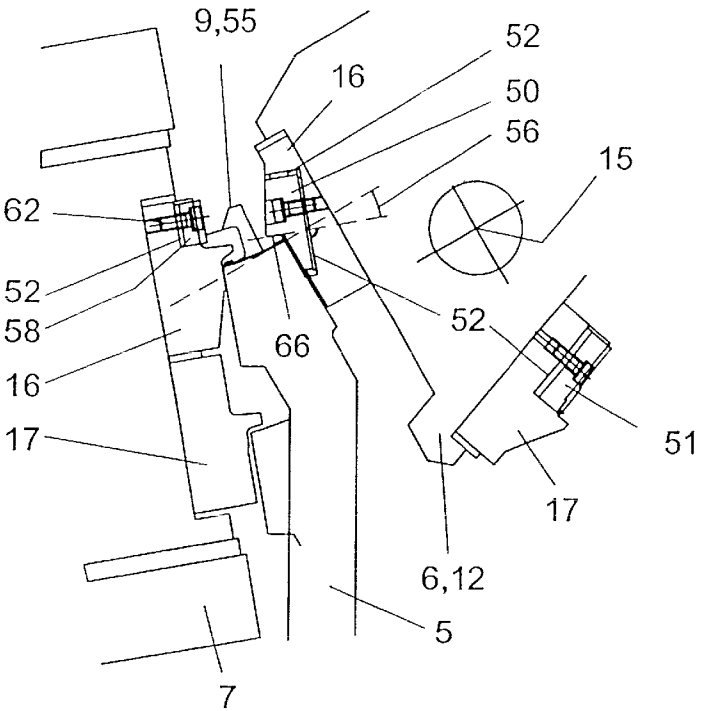
FIG. 13 is an enlarged side view of the hemming tools with integrated centering inserts for the workpieces.

In the exemplary embodiment according to FIG. 13, such a centering insert 50 is arranged on the prehemming tool 16 and is adjustably fastened preferably by apparatus of one or more fitting plates 52 and a clamping element 62, preferably a screw connection. The centering insert 50 is arranged obliquely in relation to the mount or the prehemming tool 16. Its oblique position corresponds to the prehemming angle 56 assumed by the hemming flank 66 of the prehemming tool 16. The possibility of adjustment is given as a result in the direction of the slope of the hemming flank.

The centering insert 50 is inserted frontally into a corresponding recess in the prehemming tool 16. It slightly projects over the normal hemming tool contour 53 in the manner to be described below. In preferably all embodiments, the centering inserts 50, 51, 58, 59, 60 have a contour that essentially corresponds to the contour of the hemming tool and consequently essentially also to the workpiece contour 57.

FIG. 13 shows another variant of the centering insert 51 on the finishing hemming tool 17. This insert is aligned here essentially in parallel to the base of the tool mount on the hemming head 12 and is also adjustable by apparatus of fitting plates 52 and a clamping element 62 in the above-described manner. Adjustment in a plurality of directions may be possible in both embodiments by apparatus of a plurality of fitting plates 52 arranged at an angle.

The centering insert 51 contains only the tool contour located under the hemming nose or the hemming flank 66.

FIG. 13 also shows a third variant of a centering insert 58, which is arranged, e.g., on the prehemming tool 16 of the inner hemming device 7. The centering insert 58, which is likewise adjustable, is arranged above the prehemming nose.

The centering inserts 50, 51 act on the workpieces 9 in the area of the hemming flanges 63 and center the outer contour of the workpieces 9. The centering insert 58 acts on another part of the inner contour of the workpieces 9, which may remain rigid under certain circumstances and is not hemmed. The workpiece 9 is shown in FIG. 13 as a workpiece section 55 which shows, e.g., a section through parts of the workpiece 9, especially through a window guide frame. The centering insert 58 acts on this. The window guide frame 55 and the inner part of the workpiece 9 connected thereto can be held rigidly or elastically on the hemming bed 5 by holding-down devices 67 in the clamping frame 69 and preferably by cooperation with the centering inserts 58 in the inner hemming tools 16, 17 (see FIGS. 2 and 19).

Figure 14:
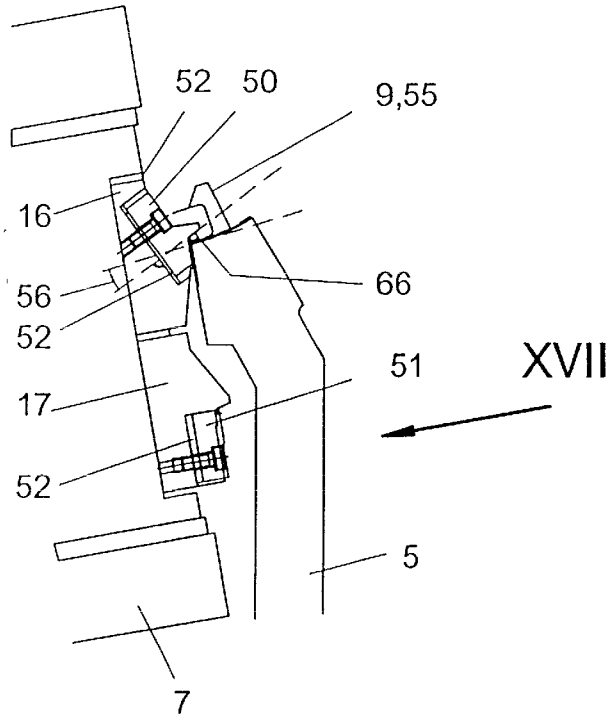
FIG. 14 is a view showing a variant of the centering device according to FIG. 13.

FIG. 14 shows a variant to FIG. 13, in which the centering inserts 50, 51 are also arranged in a corresponding form and arrangement on the prehemming and finishing hemming tools 16, 17 of the inner hemming device 7. The centering insert 50 on the prehemming tool 16 is in an oblique position here as well and is aligned corresponding to the prehemming angle 56. Due to this oblique position, the centering insert 50 can be placed especially accurately and adjusted in the direction of the hemming flank. The support and centering function is particularly good as a result and adjustment is necessary only one-dimensionally.

Figure 15:
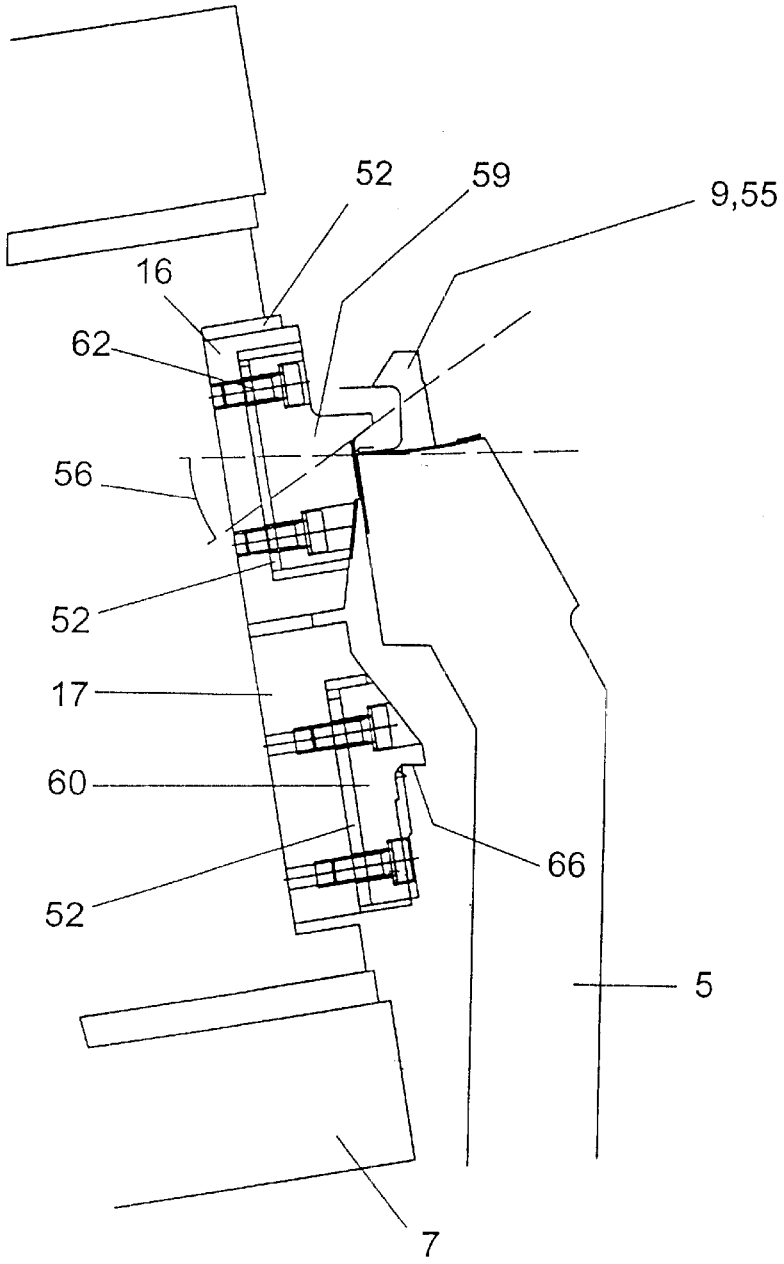
FIG. 15 is a view showing a variant of the centering device according to FIG. 13.

FIG. 15 shows another variant with centering inserts 59, 60, which have a larger form here than in the preceding exemplary embodiments and are also fastened by a plurality of clamping elements 62. They encompass nearly the entire cross-sectional contour of the hemming tools 16, 17. Moreover, the centering insert 60 on the finishing hemming tool 17 comprises, unlike in FIGS. 13 and 14, the hemming flank 66. The centering inserts 59, 60 are arranged on the inner hemming device 7 here. They may also be arranged on the hemming heads 12 of the outer hemming device 6 in a corresponding manner.

FIG. 16 illustrates the shape and the function of the centering inserts 50, 51, 58, 59, 60 in an enlarged view. The hemming tools 16, 17 are normally located at a certain laterally spaced location from the workpiece 9, 55 in their starting hemming position before the beginning of the hemming stroke. The centering inserts 50, 51, 59, 60 may slightly project over the above-mentioned normal hemming tool contour 53 with their centering contour 54 located under the hemming flank 66 and are as a result in contact with the workpiece 9, 55 with one or more surfaces. The hemming bed 5 may have one or more fitting recesses 61 for this purpose. FIG. 16 also illustrates the position of the hemming flange 63 during prehemming and finishing hemming.

The centering inserts 50, 51, 58, 59, 60 are arranged in some areas on the hemming tools 16, 17. As a result, the workpiece 9, 55 is guided and centered in a punctiform manner at a plurality of points on the outer and/or inner circumference.

The centering inserts 50, 51, 58, 59, 60 make it possible to affect the shape of the workpiece during the feed of the hemming tools 16, 17 during the inner and outer hemming and provide for this the necessary centering and holding functions, which may also be important especially during the change of the prehemming and finishing hemming tools 16, 17.

When the outer hemming device 6 is in operation and performs the prehemming, the workpiece 9, 55 is supported against the hemming forces acting on the outer circumference on the centering inserts 50, 58, 59 of the prehemming tools 16 of the inner hemming device 7. These are moved for this purpose at least into a readiness position in which the hemming flanks 66 are located at a closely spaced location above the hemming flanges 63. The centering contour 54, which preferably projects under the hemming flanks 66, will then support the workpiece 9, 55 on the inner circumference in the manner described. The projecting centering contour 54 may now bring about, e.g., a shape correction of the workpiece 9.

The inner prehemming may take place after the outer prehemming. As an alternative, the outer and inner prehemming may take place simultaneously or in a changed sequence. The supporting and centering function is equally given during the inner prehemming on the inner circumference of the workpiece 9, 55 in the area of its opening 10.

During the inner prehemming, the workpiece 9, 55 is supported on the outside on the centering pins 50, 59 of the outer hemming device 6. In the prehemming position of the outer hemming device 6, holding up is also ensured via the already bent, oblique hemming flanges 63. There is flat contact now between the hemming flange 63 and the hemming flank 66 and/or the centering contour 54.

The finishing hemming tools 17 of the outer and inner hemming device 6, 7 can be subsequently brought into position simultaneously or one after another. These now support the workpiece 9, 55 on the inside and on the outside via their centering inserts 51, 60. The projecting centering contour 54 now bridges over the free space formed during the prehemming and the rolling in of the hemming flange 63. The finishing hemming can then take place inside and outside one after another or simultaneously.

Figures 17, 18:
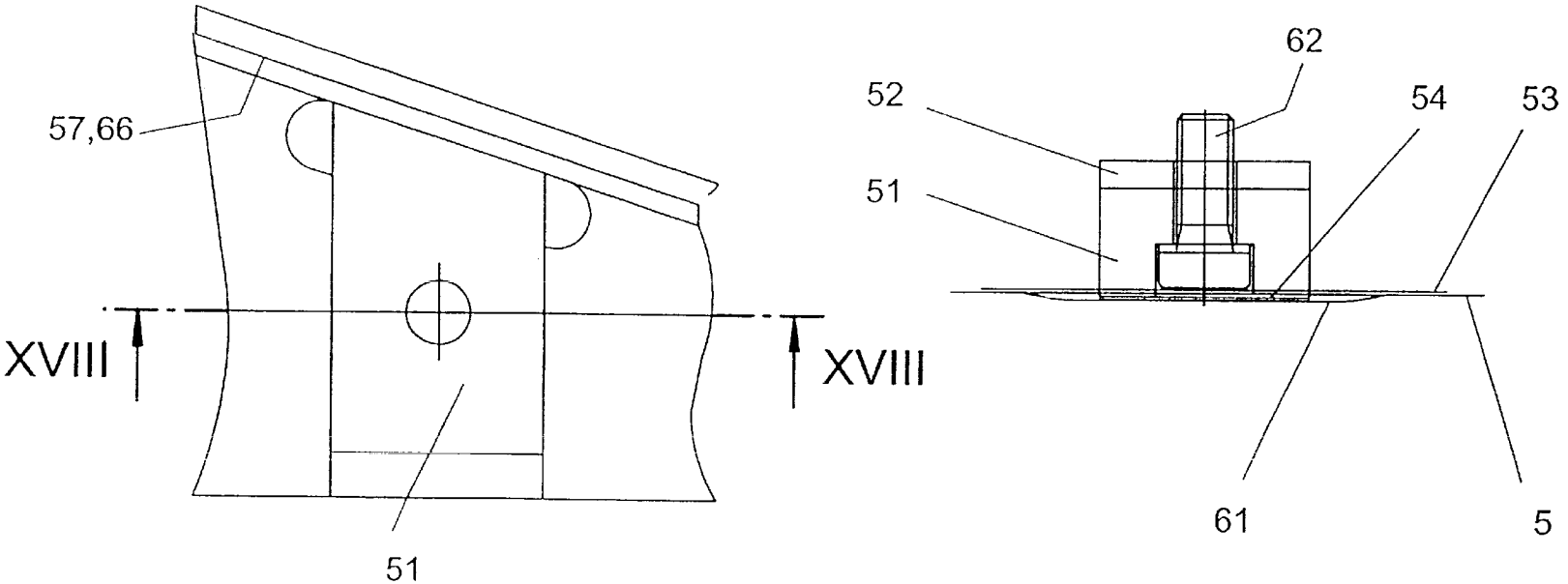
FIG. 17 is an enlarged front view of the centering insert according to FIG. 14 according to arrow XVII.
FIG. 18 is a section through the centering insert according to FIG. 17 along section line XVIII—XVIII.

FIG. 17 shows a detail view of the centering apparatus according to arrow XVII in FIG. 14. It is seen here how, e.g., a centering insert 51 is fitted to the workpiece contour 57 and how it fills the area up to the hemming flank 66.

FIG. 18 shows a section along section line XVIII—XVIII in FIG. 17. The projection of the centering contour 54 in relation to the normal hemming tool contour 53 is recognized from this view on the example of a centering insert 51. In addition, the association and the shape of the recess 61 in the hemming bed 5 are seen. FIG. 18 also shows the limited width of the centering inserts 50, 51, 58, 59, 60.

If the centering and/or support function of the centering inserts 50, 51, 59, 60 is not desired or necessary due to the projecting adjustment of the centering contour 54, the centering contour 54 remains flush with the hemming tool contour 53, which may optionally continue to be present on the hemming tool 16, 17 and may also have support and/or centering function.

Various modifications of the embodiment shown are possible. On the one hand, the hemming heads 12 may be designed, mounted and driven differently. Instead of a crank drive, it is also possible to use any other power and movement transmission apparatus. The drive for the hemming head 12 may also contain any other drive element instead of the cylinder. In addition, the hemming heads 12 may be combined with any other hemming drive 14 of a different design. Besides fluidic, i.e., hydraulic or pneumatic, drives, electric drives with suitable motors, transmissions and spindles may also be used as the hemming drive 14. In addition, separate drives may be used for feeding the hemming unit and for the hemming stroke. The various units may be combined, expanded or reduced as desired depending on the task. For example, the lifters 8 may be eliminated altogether in the case of the direct feed of the workpiece 9 onto the hemming bed 5.

In another variant, the hemming apparatus 1 may have only one outer hemming device 6. The centering inserts 50, 51, 58, 59, 60 may also be arranged on the outer hemming units 11 only. Furthermore, the clamping apparatus 3 and the other machine parts of the hemming apparatus 1 are variable as well. In particular, the clamping apparatus 3 may be movable linearly. The clamps 4 may also be mounted stationarily on the machine frame 2 instead of on the movable hemming units 11.

While specific embodiments of the invention have been shown and described in detail to illustrate the application of the principles of the invention, it will be understood that the invention may be embodied otherwise without departing from such principles.

What is claimed is:

1. A hemming apparatus, comprising:

a hemming device with hemming tools;

a clamping apparatus with flexible sequence controlled pressing and clamping elements for contact with the workpiece, said pressing and clamping elements including a leading pressing and clamping element and remaining pressing and clamping elements, said leading pressing and clamping element comprising a movable or deformable element with said leading pressing and clamping element contacting the workpiece prior to said remaining pressing and clamping elements, wherein said leading pressing and clamping element has an adjustable location of application on the workpiece relative to the remaining pressing and clamping elements and an adjustable time of application on the workpiece relative to the remaining pressing and clamping elements and an adjustable pressure of application on the workpiece relative to the remaining pressing and clamping elements.

2. A hemming apparatus, comprising:

a hemming device with hemming tools;

a clamping apparatus with flexible sequence controlled pressing and clamping elements for contact with the workpiece, said pressing and clamping elements including a leading pressing and clamping element and remaining pressing and clamping elements, said leading pressing and clamping element comprising a movable or deformable element with said leading pressing and clamping element contacting the workpiece prior to said remaining pressing and clamping elements, wherein said hemming device includes a hemming device acting on an outer peripheral portion of the workpiece and a hemming device acting on an interior opening peripheral surface of the workpiece aligned in relation to the workpiece independently from one another and being actuatable separately.

3. A hemming apparatus, comprising:

an outer hemming device;

an inner hemming device, said outer and inner hemming devices being positioned and aligned in relation to the workpiece independently from one another and being actuated separately; and a clamping apparatus with pressing and clamping elements and a plurality of leading pressing and clamping elements for contact with the workpiece prior to said pressing and clamping elements.

4. A hemming apparatus in accordance with claim 3, wherein clamping apparatus has at least one movable clamping frame.

5. A hemming apparatus in accordance with claim 3, wherein each of said outer hemming device and said inner hemming device has a plurality of hemming units each with a hemming drive, said hemming units being separately actuatable.

6. A hemming apparatus in accordance with claim 5, wherein said hemming devices have hydraulic drives.

7. A hemming apparatus in accordance with claim 3, wherein said hemming tools have one or more centering inserts and said centering inserts have a projecting centering contour and a hemming bed is provided with fitting recesses.

8. A hemming apparatus, comprising:

a hemming device for hemming one of an outer peripheral part of a workpiece and an internal peripheral part of an opening of a workpiece;

a clamping apparatus with flexible sequence controlled pressing and clamping elements for contact with the workpiece including a leading pressing and clamping element and remaining pressing and clamping elements, wherein said leading pressing and clamping element contacts with the workpiece prior to said remaining pressing and clamping elements, said leading pressing and clamping element comprising a movable or deformable element having an adjustable location of application on the workpiece relative to the remaining pressing and clamping elements, having an adjustable time of application on the workpiece relative to the remaining pressing and clamping elements and having an adjustable pressure of application on the workpiece relative to the remaining pressing and clamping elements.

* * * * *